US010760864B1

(12) United States Patent
Faughn

(10) Patent No.: US 10,760,864 B1
(45) Date of Patent: Sep. 1, 2020

(54) MAGAZINE ASSEMBLY PROVIDING TACTILE INDICATION OF AMMUNITION LEVEL

(71) Applicant: U.S. Army Research Laboratory ATTN: RDRL-LOC-I, Adelphi, MD (US)

(72) Inventor: Jim A. Faughn, Glen Arm, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/378,628

(22) Filed: Apr. 9, 2019

(51) Int. Cl.
*F41A 9/62* (2006.01)
*F41A 9/65* (2006.01)

(52) U.S. Cl.
CPC . *F41A 9/62* (2013.01); *F41A 9/65* (2013.01)

(58) Field of Classification Search
CPC ..... F41A 9/62; F41A 9/65
USPC ..... 42/1.01, 1.02, 1.03
See application file for complete search history.

(56) References Cited

U.S. PATENT DOCUMENTS 5,206,444 A * 4/1993 Oliver ..... F41A 9/62 42/1.02
9,857,131 B1 * 1/2018 Rose ..... F41A 9/62
2011/0078936 A1 * 4/2011 Gates ..... F41A 9/62 42/1.02

FOREIGN PATENT DOCUMENTS

EP 549288 * 6/1993

* cited by examiner

*Primary Examiner* — Stephen Johnson
(74) *Attorney, Agent, or Firm* — Alan I. Kalb

(57) ABSTRACT

A magazine, magazine assembly, magazine retrofit kit and/or portion thereof configured to provide tactile indication of magazine ammunition level.

18 Claims, 4 Drawing Sheets

29
3
27
26
25
41
35
44
8
9
29
41
27
26
25
35
34
3
2
1

"20" ROUNDS
"15" ROUNDS
13
14
"10" ROUNDS
"0" ROUNDS
ORGANIC CUE

400

MAGAZINE ASSEMBLY PROVIDING TACTILE INDICATION OF AMMUNITION LEVEL

GOVERNMENT INTEREST

The invention described herein may be manufactured, used and/or licensed by or for the Government of the United States for all governmental purposes without the payment of any royalty.

FIELD OF THE DISCLOSURE

The present disclosure relates generally to weaponry and, more particularly, to a magazine for a firearm.

BACKGROUND

There are many previously known magazines that are used to store and provide ammunition for weapons and firearms of different sizes, calibers, and configurations. For example, a box magazine includes an elongated housing defining a channel in which stacked ammunition is contained. A spring-loaded follower is also contained within the channel and abuts against a lower end of the stacked ammunition to urge the stack of ammunition upward from the magazine toward a loading chamber of the firearm.

It is desirable to be able to rapidly determine an amount of ammunition remaining within the magazine. Such information is particularly advantageous in combat situations. Prior mechanisms/magazines address this problem via visual indicators such as a longitudinal slot in the magazine (e.g., open or with a clear window), or translucent materials, through which remaining ammunition or at least the bottom of the magazine stack may be seen and the like. Unfortunately, this requires the shooter to take his or her eyes off a target to visually look at the magazine and is also ineffective when vision is degraded under low/no light conditions or if the visual attributes of the magazine are obscured by mud, dirt, blood, oil. etc.

SUMMARY OF THE INVENTION

Various deficiencies in the prior art are addressed below by the disclosed systems, methods, architectures, mechanisms and/or apparatus providing a magazine, magazine assembly, magazine retrofit kit and/or portion thereof configured to provide tactile indication of magazine ammunition level.

A magazine according to one embodiment comprises an elongated housing having a channel dimensioned to contain a plurality of stacked ammunition between a first and a second end of the housing, and having a slot defined along a side of the housing; a spring loaded follower mounted in the housing and adapted to abut against one end of the stacked ammunition adjacent the second end of the housing and configured to urge the stacked ammunition toward the first end of the housing; a tactile indicator assembly configured to mechanically cooperate with the spring loaded follower and having a protruding portion configured to extend through the slot in the magazine housing, the protruding portion moving toward the second end of the housing as the stacked ammunition increases, and moving toward the first end of the housing as the stacked ammunition decreases.

A magazine assembly according to another embodiment comprises an elongated housing having a channel dimensioned to contain a plurality of stacked ammunition between a first and a second end of the housing; an external indicator housing defined along a side of the elongated housing and having disposed therein a tactile indicator mule including a magnet; a spring loaded follower mounted in the elongated housing and adapted to abut against one end of the stacked ammunition adjacent the second end of the elongated housing and configured to urge the stacked ammunition toward the first end of the elongated housing; a tactile indicator assembly configured to mechanically cooperate with the spring loaded follower and to magnetically cooperate with the tactile indicator mule, the tactile indicator moving toward the second end of the elongated housing as the stacked ammunition increases, and moving toward the first end of the elongated housing as the stacked ammunition decreases.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

Figures 1A, 1B, 1C:
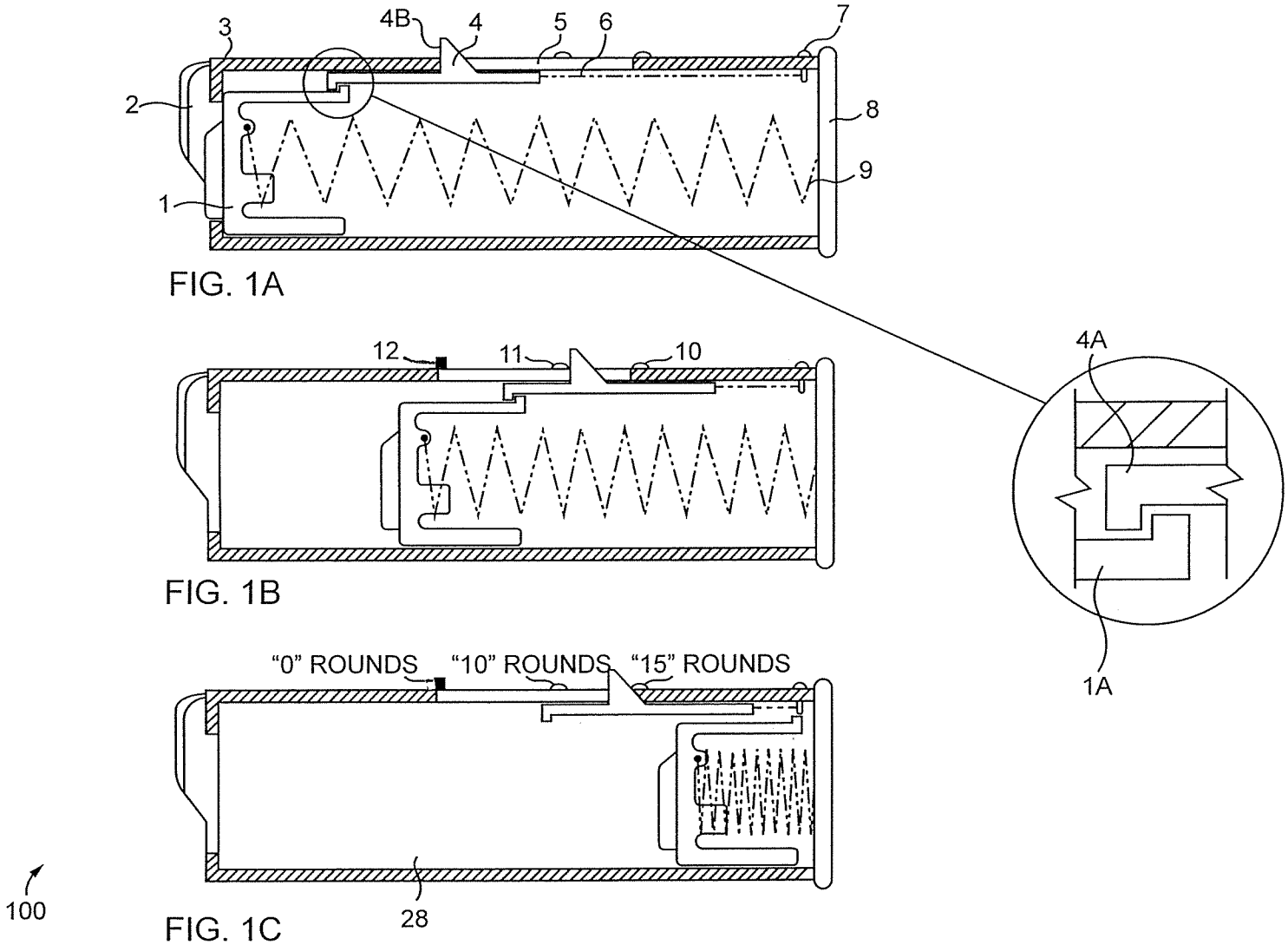
FIGS. 1A-C depict cutaway views of a box magazine according to an embodiment.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for illustrative purposes to aid the reader in understanding the principles of the invention and the concepts contributed by the inventor to furthering the art and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments.

Generally speaking, the various embodiments enable tactile indication to a warfighter of an amount of ammunition remaining in a magazine of a weapon. It should be noted that while the various embodiments are primarily directed to box magazines, other types of magazines may also be adapted in accordance with the teachings herein and, as such, these other types of magazines are also contemplated to be within the scope of the various embodiments. Such other types of magazines may comprise, for example, box, drum, casket, pan, tubular, rotary, horizontal, helical and other magazines. Further, while most magazines are detachable from the weapon to enable rapid reloading, the various embodiments also find utility with non-detachable magazines of whatever type.

FIGS. 1A-C depict cutaway views of a box magazine according to an embodiment. The box magazine comprises, illustratively, a 30 round magazine (rounds in magazine are not shown for clarity) in which a tactile indicator provides a tactile indication of a number of rounds remaining in the box magazine by moving in conjunction with a follower in the magazine as rounds are expended.

Specifically, the magazine 100 of FIG. 1 comprises an elongated magazine body 3 having a lower portion sealed by a floor plate 8 and an upper portion including feed lips 2. The magazine body 3 may be constructed of any conventional material, such as plastic or metal, and defines therein an elongated channel 28 which is dimensioned to contain a stack of ammunition. The actual dimension of the channel 28 will vary depending upon the caliber and type of ammunition contained by the magazine 100.

The upper portion of the magazine body 3 is adapted for detachable connection with a firearm. The feed lips 2 are positioned in alignment with an ammunition loading chamber on the firearm. Thus, in the conventional fashion, as the ammunition moves into the loading chamber (and out of the magazine) and then is subsequently discharged by the firearm, the stack of ammunition (not shown) moves upwardly within the housing chamber 28.

In order to urge the ammunition stack towards the upper portion of the feed lips 2, a follower 1 is contained within the magazine channel 28. The follower 1 abuts against the lower end of the stack of ammunition. A follower compression spring 9 is contained within the follower 1 and is compressed against the floor plate 8 as the follower is displaced toward the floor plate 8 by the loading of ammunition into the channel 28 of the magazine 100.

When the magazine 100 is initially completely loaded with its maximum number of shells of ammunition, the follower 1 is positioned adjacent the floor plate 8 at (or near) the bottom of the magazine and the follower spring 9 is in a state of maximum compression. Conversely, as shells are fired by the firearm, the follower 1 moves upwardly within the magazine channel 28. Consequently, the longitudinal position of the follower 1 within the magazine channel 28 is directly proportional to the number of ammunition shells (e.g., 30 rounds) contained within the magazine 100.

A tactile indicator 4 comprises, illustratively, an elongated member having the engagement notch 4A and protruding portion 4B; namely a protrusion from the magazine body suitable for tactile communication indicative of a remaining amount of ammunition in the magazine. While the tactile indicator 4 is depicted as a "shark fin" type of tactile indicator, other types and shapes of indicators may be used within the various embodiments (e.g., rounded tabs, square tabs, cylindrical pins, rectilinear protrusions, spherical shapes and the like).

Follower 1 includes a follower engagement notch 1A which is configured to mechanically cooperate with the engagement notch 4A of tactile indicator 4 so that the follower 1 and tactile indicator 4 move in conjunction while the protruding portion 4B of the tactile indicator protruding from the magazine body 3 provides an indication of an amount of ammunition remaining in the magazine. The tactile indicator engagement notch 4A is kept in intimate contact with the follower engagement notch 1A via tension applied in the opposite direction by a tensile retractor 6, which at one end is attached to the end of the tactile indicator opposite that including the engagement notch 4A, and at another end attached to a retractor anchor 7 illustratively located at the base of the magazine body 3 near the floor plate 8. The tensile retractor 6 applies a tensile force to the tactile indicator 4 at substantially all times such that the engagement notch 4A is positively engaged, and in constant contact with, the engagement notch 1A of the follower as the protruding portion 4B of the tactile indicator 4 moves within the magazine indicator slot 5.

As depicted in FIG. 1A-C, the protruding portion 4B of the tactile indicator 4 protrudes through a magazine indicator slot 5 through the magazine body 3 of the magazine 100. The protruding portion 4B of the tactile indicator 4 moves back and forth within the magazine indicator slot 5 in response to motion of the follower 1. It is noted that magazine indicator slot 5 runs through only a portion of the magazine body 3, such that tactile indication is only meaningfully provided for a subset of the possible amount of ammunition, such as the final 15 rounds in a 30 round magazine. However, in other embodiments the magazine indicator slot 5 and tactile indicator 4 may be modified to indicate the full number of rounds in the magazine 100.

As depicted in FIG. 1A-C, the tactile indicator traverses a magazine indicator slot 5 located on the back-strap portion of the magazine body 3. However, the magazine indicator slot(s) 5 may be located on any side(s) of the magazine body 3. Further, multiple magazine indicator slots 5/tactile indicators 4 may be utilized in various embodiments.

FIG. 1A depicts the case where the magazine 100 is empty; that is, zero rounds of ammunition. In this case, the follower 1 is pushed up against the feed lips 2 by the follower spring 9, which is held in place by the floor plate 8, which is secured to the magazine body 3. The tactile indicator protruding portion 4B is located at the top end of the indicator slot (static or tactile cue position 12), thereby indicating that the number of rounds in the magazine body 3 is zero.

FIG. 1B depicts the case where the magazine 100 is about one third full; illustratively 10 rounds of ammunition (not shown) in a 30 round magazine. In this case, the follower 1 is pushed toward the floor plate 8 by the number of inserted rounds of ammunition in the magazine. The tactile indicator protruding portion 4B is located near the middle of the indicator slot 5 (static cue position 11 indicating 10 rounds remaining), thereby indicating that the number of rounds in the magazine body 3 is approximately one third of the total capacity of the magazine (10 rounds of a 30 round magazine) and two thirds of the indicator slot 5 which indicates from 0 to 15 rounds out of a 30 round magazine.

In particular, as rounds are loaded into the magazine, they abut against the follower 1 and push it downwards towards the floorplate 8 concomitantly compressing the follower spring 9. No rounds are depicted in this drawing (for clarity and ease of understanding) but the follower is shown as it would move inside the magazine when moved by rounds being loaded. As the follower 1 moves towards the floor plate 8, the follower engagement notch 1A begins to move away from the tactile indicator engagement notch 4A; however, the tactile indicator engagement notch 4A is then pulled rearward towards the floorplate 8 by the tensile retractor 6. This keeps the tactile indicator engagement notch 4A in constant and intimate contact with the follower engagement notch 1A at all times as the follower 1 continues to move rearward towards the floorplate 8 along with the tactile indicator 4.

When the protruding portion of the tactile indicator 4B has traveled the length of the magazine indicator slot 5 (reaching the rearmost position of that slot), it will be prevented from traveling further than static cue 10, which is indicative of, illustratively, 15 rounds. The protruding indicator 4B in this most rearward position in the magazine indicator slot 5 indicates 15 rounds are remaining in the magazine. The rearward movement of the indicator is halted by the rear most wall of the magazine indicator slot 5.

As the tactile indicator 4 intersects with the magazine indicator slot 5, its rearward travel is stopped. However, as additional rounds are loaded into the magazine the follower 1 continues its travel rearward towards the floor plate, leaving the tactile indicator 4 in its most rearward position within magazine indicator slot 5. It is noted that as the rounds are loaded into the magazine, the tactile indicator 4 will move within the magazine indicator slot 5.

The magazine indicator slot 5 depicted herein is associated with several static cues; namely, static cues at position 12 (indicative of an empty magazine/"0" rounds), position 11 (indicative of a final number of rounds in the magazine, illustratively ten), and position 10 (indicative of a full magazine or a magazine having more than half of its rounds remaining, illustratively 15 of a 30 round magazine). The static cues 10, 11 and 12 are small protuberances designed to provide tactile cues to the user's digits as they sweep the back strap (or other side(s)) of the magazine in search of the tactile indicator 4B protruding therefrom. The static cues are sized to be large enough to be tactilely felt by fingers inside a Combat Glove or similar gloves that could be used for shooting.

In one embodiment, the static cue at position 11 comprises two protuberances located on opposing sides of the magazine slot 5. This provides the warfighter with a distinctive tactile clue as to where the tactile indicator 4B is located in relation to the other static cues. In one embodiment, static queue position 10 (15 round position) comprises a single static cue located adjacent to the end of, and on the centerline of, the magazine indicator slot 5. This single Static Cue provides unique tactile information to the warfighter as to the relative position of the tactile indicator 4B within the magazine slot 5. The tactile cues must be unique and significantly different from each other to ensure positive identification at each round count cue to avoid confusion of the cues. The second end (edge) of the magazine 100 also operates as a static (organic) cue, but it may be difficult for a war fighter to know where the 15 round position was in relation to the end of the magazine.

Therefore, by placing a single static cue at the 15 round position (cue 10), a distinctive tactile mechanism enabling the war fighter to differentiate and define the relative location of the tactile indicator 4B is provided. The optional tactile cue 12 (0 rounds) is useful because the edge of the magwell's base (of the weapon) acts as an organic "0" round tactile cue when the magazine is inserted into it—but when the magazine is outside the weapon magwell the warfighter must be able to know that the protruding "Shark Fin" indicator is at the "zero" rounds position in the "Shark Fin" track 5. So in this case the "0" round indicator 12 is a small ridge which is normal to the slot 5 and is located on both sides of the slot 5. Its shape is significantly different and thus uniquely discernable from the other static cues at 11 and 10 via tactile means. It is noted that static cues can be either a single cue or multiple cues and/or of any shape, location, number, or feature that distinguishes them from each other or from a particular position to establish uniqueness.

In one embodiment, there is no static cue provided at the empty or "0" rounds position, since the tactile indicator 4 will be abutted against the mag well of the weapon and the "0" position in the magazine slot 5. In other embodiments, static cue 12 is provided to proximate this position. The user may position his/her thumb below the magwell edge and on the magazine blackstrap (which is a normal weapon gripping position) such that as tactile indicator 4B moves within the magazine indicator slot 5 as rounds are expended the protruding portion of the tactile indicator 4B will move beneath the 1st digit (thumb) of the user and thereby let the user know exactly when they are about to run dry on ammunition. This provides a "real time" tactile indication of the rounds being depleted from the magazine and alerts the warfighter to knowing the magazine will be empty in so many rounds. From the 0 rounds cue 12 position if the user places their thumb on the backstrap abutting the magazine well's base edge it will allow the user to feel the Shark Fin as it progresses towards the 12 cue 0 rounds—the thumb width approximates a rounds remaining value of 5.

In the various figures the static cues (e.g., 12, 11 and 10 of FIGS. 1A-1C) are depicted as substantially rounded or dome-shaped. However, it is to be understood that various embodiments utilize tactile cues that are of differing shapes and sizes, such as rectangular, elongated rectangular, triangle and so on. In particular, various embodiments contemplate that the most important of the tactile cues (i.e., the cue indicative of a critically low amount of ammunition such as five or three or zero remaining rounds) is distinctive in shape as compared to the other tactile cues (e.g., cue 12 being rectangular while cues 11 and 10 are dome-shaped).

In the illustrative example, a 30 round magazine is depicted, though the same principles apply to other sized magazines of any capacity (e.g., 5, 10, 20, 30, 40, 60, 100, etc.). For example, in 30 round magazines (or larger magazines), the last 15 rounds are critical to the war fighter, and the last five or fewer rounds are extremely critical to the war fighter in any magazine of any capacity. As such, some embodiments only provide a change of indication when a magazine is down to 15 rounds or less.

FIG. 1C depicts the case where the magazine 100 is either full or at least full beyond some predetermined amount of ammunition (e.g., 15 of 15 rounds, 15 of 30 rounds and the like). In this case, the follower 1 has continued its rearward/downward movement as rounds are loaded into the magazine (past the 15 rounds indicated by the static cue 10 at 15 rounds) and when the full complement of rounds are loaded into the magazine it will cease movement at its rearward most position near the floorplate 8, at which point the follower spring 9 is fully compressed and is at maximum compressive force. As rounds are fired from the weapon or ejected from the magazine, the follower 1 will begin movement towards the feed lips 2 under compressive spring force supplied by the follower spring 9. As the follower engagement notch 1A reengages with the tactile indicator engagement notch 4A it will again begin to pull the tactile indicator 4 along with it until the follower 1 reaches its full travel and rests at the feed lips 2 position, such as depicted in the view of FIG. 1A.

Figures 2A, 2B, 2C:
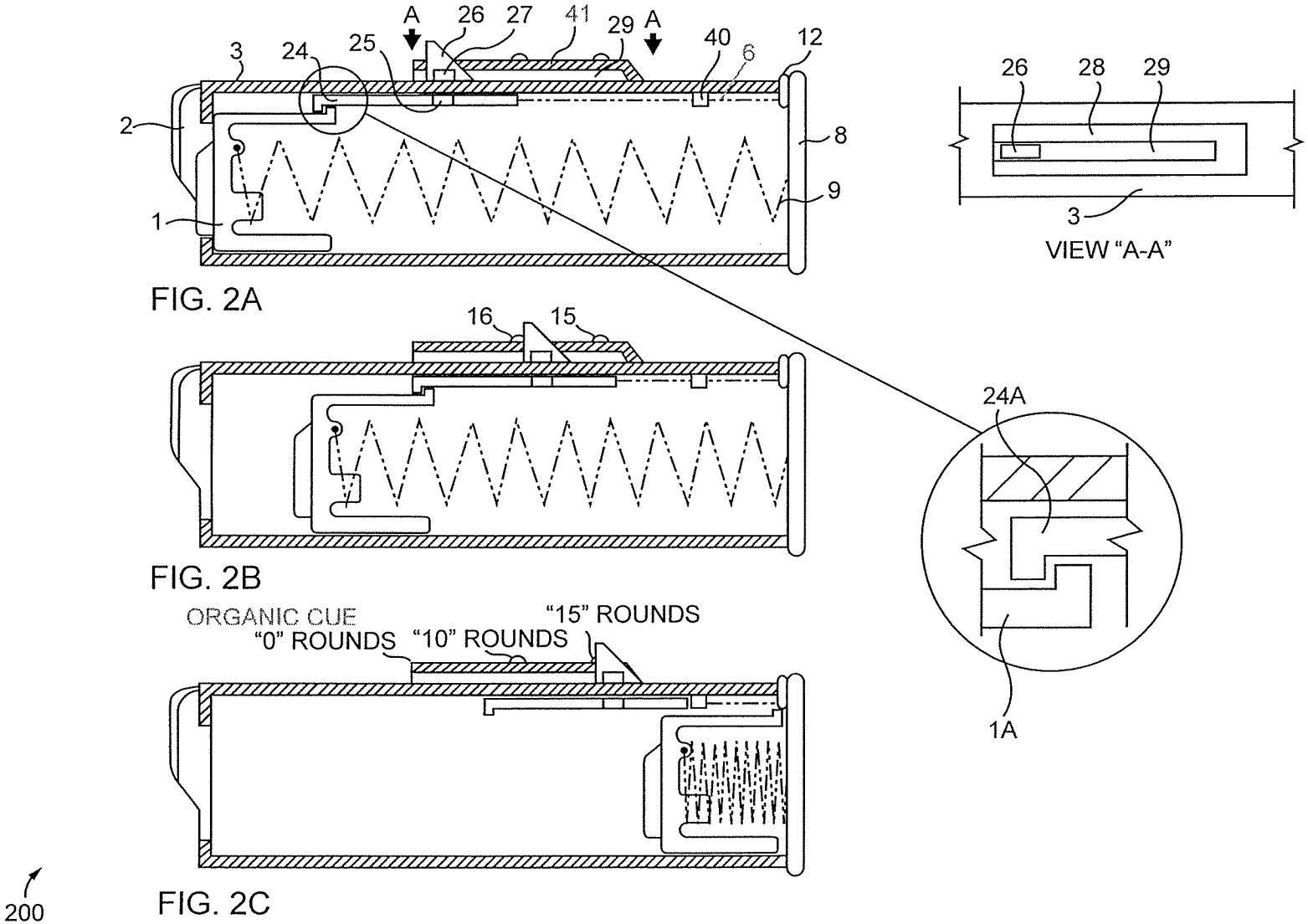
FIGS. 2A-C depict cutaway views of a box magazine according to an embodiment.

FIGS. 2A-C depict cutaway views of a box magazine according to an embodiment. The magazine 200 of FIGS. 2A-C is similar in many respects to that of the magazine 100 of FIGS. 1A-C and, as such, the below description of the magazine 200 of FIGS. 2A-C will primarily focus upon the differences between the various embodiments. Generally speaking, the magazine body 3 depicted in FIG. 2A does not include the magazine slot 5 described above with respect to FIG. 1A and, as such, there is no protruding portion 4B of a tactile indicator 4 depicted in the embodiments of FIG. 2A.

Referring to FIG. 2A, tactile indication is provided via an indicator 26 having (or comprising) a magnet 27 and contained within a slotted indicator housing 41 external to the magazine body 3 and magnetically cooperating with a magnet 25 of an indicator mule assembly 24 internal to the magazine body 3. The indicator 26 moves towards the first and second ends of the magazine body 3 in response to, respectively, decreases and increases in ammunition count within the ammunition stack.

Referring to FIG. 2A, the tactile indicator mule 24 comprises, illustratively, an elongated member having the engagement notch 24A configured to cooperate with the engagement notch 1A of the follower 1 as previously described, as well as the magnet 25 configured to cooperate with the magnet 27 of the indicator 26. In particular, the follower engagement notch 1A is configured to mechanically cooperate with the engagement notch 24A of tactile indicator mule 24 so that the follower 1 and tactile indicator mule 24 move in conjunction while the magnetically coupled indicator 26 protruding from the slotted indicator housing 41 provides a tactile indication of an amount of ammunition remaining in the magazine.

The slotted indicator housing 41 comprises a metal or plastic housing mounted external to the magazine body 3 and configured to substantially retain the indicator/magnet 26/27 while allowing the indicator/magnet 26/27 to move within a slot 29 formed thereby.

The tactile indicator mule engagement notch 24A is kept in intimate contact with the follower engagement notch 1A via tension applied in the opposite direction by a tensile retractor 6, which at one end is attached to the end of the tactile indicator mule 24 opposite that including the engagement notch 24A, and at another end attached to a retractor anchor 12 illustratively located at the base of the magazine body 3 near the floor plate 8. The tensile retractor 6 applies a tensile force to the tactile indicator mule 24 at substantially all times such that the engagement notch 24A is positively engaged, and in constant contact with, the engagement notch 1A of the follower 1.

FIG. 2A depicts the case where the magazine 200 is empty; that is, zero rounds of ammunition. In this case, the follower 1 is pushed up against the feed lips 2 by the follower spring 9, which is held in place by the floor plate 8, which is secured to the magazine body 3. The indicator 26 is protruding from a top end of the slotted indicator housing 41, thereby indicating that the number of rounds in the magazine 200 is zero. The first end of the slotted indicator housing 41 generally forms a sharp edge which can be used as an organic tactile cue to indicate 0 rounds in the magazine, this also applies to magazine 400.

FIG. 2B depicts the case where the magazine 200 is about one third full; illustratively ten rounds of ammunition (not shown) in a 30 round magazine. In this case, the follower 1 is pushed toward the floor plate 8 by the number of inserted rounds of ammunition in the magazine. The tactile indicator 26 is located near a middle of the slot 29 of the slotted indicator housing 41, thereby indicating that the number of rounds in the magazine 200 is approximately 10 rounds of the total capacity of the magazine (30) and two thirds of the indicator slot which indicates from 0 to 15 rounds.

FIG. 2C depicts the case where the magazine 200 is either full or at least full beyond some predetermined amount of ammunition (e.g., 15 of 15 rounds, 15 of 30 rounds and the like). In this case, the follower 1 has continued its rearward/downward movement as rounds are loaded into the magazine (e.g., past tactile cue 16 indicating 10 rounds are remaining, and also past the 15 rounds remaining as indicated by the tactile indicator 26 at tactile cue 15) and when the full complement of rounds are loaded into the magazine it will cease movement at its rearward most position near the floorplate 8, at which point the follower spring 9 is fully compressed and is at maximum compressive force. With the follower 1 in its most rearward position, the forward movement of indicator mule 24 is halted by a mule stop 40. This ensures that the two magnets 25 and 27 remain in constant communication with each other so as to "hold" the tactile indicator 26 in its rest position such that it is not allowed to move as the follower 1 continues its downward movement past the 15 rounds cue 15.

As rounds are fired from the weapon or ejected from the magazine, the follower 1 will begin movement towards the feed lips 2 under compressive spring force supplied by the follower spring 9. As the follower engagement notch 1A reengages with the tactile indicator engagement notch 24A it will again begin to pull the tactile indicator mule 24 along with it until the follower 1 reaches its full travel and rests at the feed lips 2 position, such as depicted in the view of FIG. 2A.

Figures 3A, 3B, 3C:
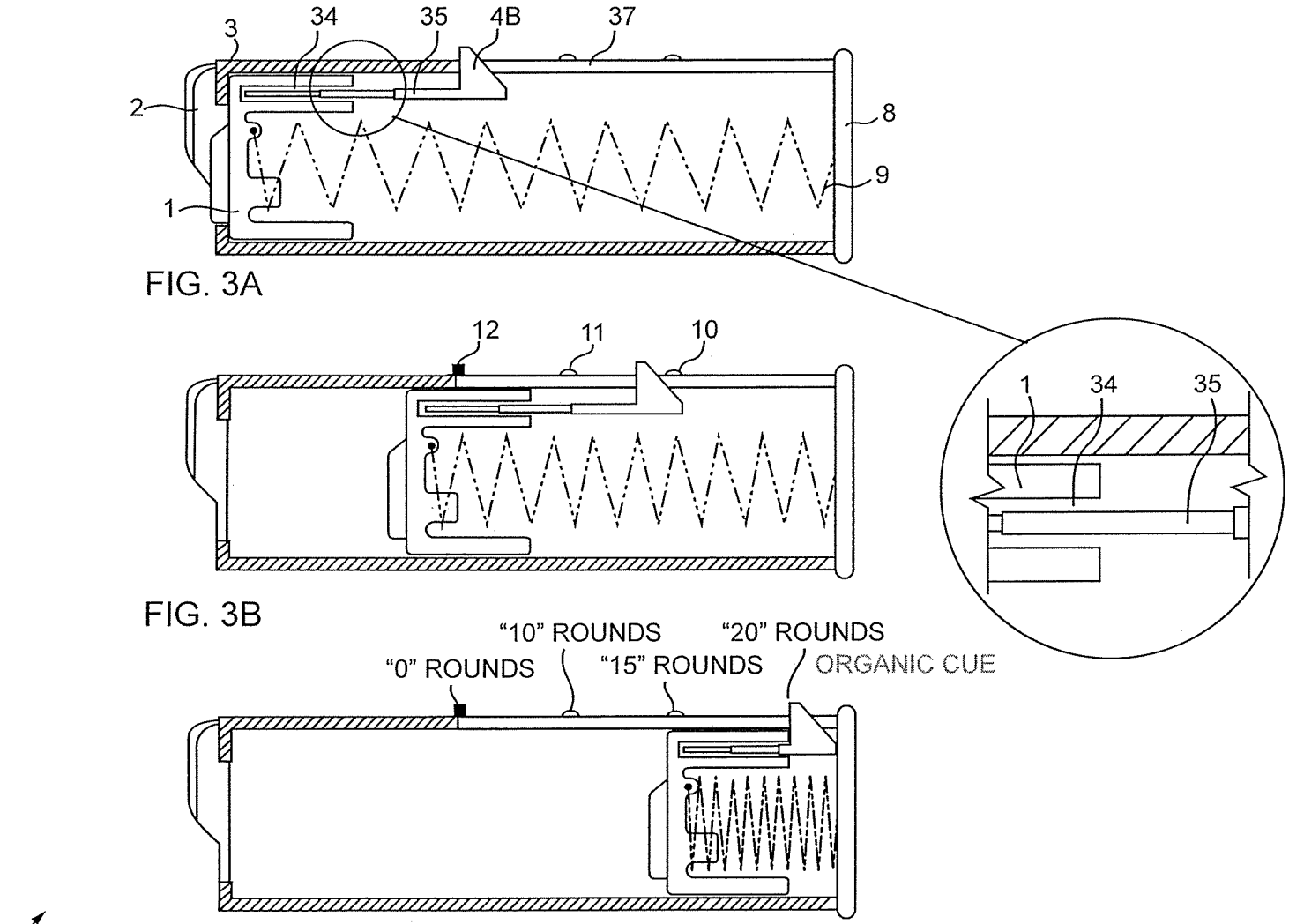
FIGS. 3A-C depict cutaway views of a box magazine according to an embodiment.

FIGS. 3A-C depict cutaway views of a box magazine according to an embodiment. The magazine 300 of FIGS. 3A-C is similar in many respects to that of the magazine 100 of FIGS. 1A-C and, as such, the below description of the magazine 300 of FIGS. 3A-C will primarily focus upon the differences between the various embodiments. Generally speaking, instead of having a breakaway coupling as depicted above with respect to the magazine 100 of FIGS. 1A-C (i.e., the engagement notches 1A and 4A), the magazine 300 of FIGS. 3A-C uses a telescoping leg assembly attached to the follower 1 to move a tactile indicator assembly.

Referring to FIG. 3A, an elongated member having a telescoping leg 35 which is connected to and extends from a follower cavity 34, and a protruding portion 4B; namely a protrusion from the magazine body 3 suitable for tactile communication indicative of a remaining amount of ammunition in the magazine.

Follower 1 includes the follower cavity 34, which is configured to mechanically cooperate with the telescoping leg 35 of the tactile indicator such that the follower 1 and tactile indicator 4 move in conjunction while the protruding portion 4B of the tactile indicator protruding from the magazine body 3 provides an indication of an amount of ammunition remaining in the magazine. The telescoping leg 35 is configured to exhibit an extending tension such that tactile protruding portion 4B is urged toward the floorplate 8 as the tactile indicator 4 moves within the magazine indicator slot 37.

As depicted in FIGS. 3A-C, the protruding portion 4B of the tactile indicator 4 protrudes through a magazine indicator slot 37 through the magazine body 3 of the magazine 300. The protruding portion 4B of the tactile indicator 4 moves back and forth within the magazine indicator slot 37 in response to motion of the follower 1. It is noted that magazine indicator slot 37 runs through only a portion of the magazine body 3, such that tactile indication is only meaningfully provided for a subset of the possible amount of ammunition, such as the final 15 rounds in a 30 round magazine. However, in other embodiments the magazine indicator slot 37 and tactile indicator 4 may be modified to indicate the full number of rounds in the magazine(s) 100 or 300.

As depicted in FIG. 3A-C, the tactile indicator 4 traverses a magazine indicator slot 37 located on the back strap portion of the magazine body 3. However, the magazine indicator slot 37 may be located on any side(s) of the magazine body 3. Further, multiple magazine indicator slots 37/tactile indicators 4B may be utilized in various embodiments.

FIG. 3A depicts the case where the magazine 300 is empty; that is, zero rounds of ammunition. In this case, the follower 1 is pushed up against the feed lips 2 by the follower spring 9, which is held in place by the floor plate 8, which is secured to the magazine body 3. The tactile indicator protruding portion 4B is located at the top end of the indicator slot 37 (static cue position 12), thereby indicating that the number of rounds in the magazine 300 is zero. It is noted that the telescoping leg 35 is substantially fully extended.

FIG. 3B depicts the case where the magazine 300 is about half full; illustratively fifteen rounds of ammunition (not shown) in a 30 round magazine. In this case, the follower 1 is pushed toward the floor plate 8 by the number of inserted rounds of ammunition in the magazine. The tactile indicator protruding portion 4B is located somewhat near the middle of the indicator slot 37 (static cue position 10), thereby indicating that the number of rounds in the magazine 300 is approximately half of the total capacity. It is noted that the telescoping leg 35 is substantially fully extended.

FIG. 3C depicts the case where the magazine 300 is either full or at least full beyond some predetermined amount of ammunition (e.g., 15 of 15 rounds, 20 of 30 rounds and the like). In this case, the follower 1 has continued its rearward/downward movement as rounds are loaded into the magazine (past the 15 rounds indicated by the tactile indicator 4B at static cue 10) and when the full complement of rounds are loaded into the magazine it will cease movement at its rearward most position near the floorplate 8, at which point the follower spring 9 is fully compressed and is at maximum compressive force. When the tactile indicator 4B is at the floor plate position 8 the bottom of the floor plate acts as an organic tactile cue indicating that the magazine is full and has at least 20 rounds remaining (in this particular example). As rounds are fired from the weapon or ejected from the magazine, the follower 1 will begin movement towards the feed lips 2 under compressive spring force supplied by the follower spring 9. It is noted that the telescoping leg 35 is substantially fully contracted.

Figures 4A, 4B, 4C:
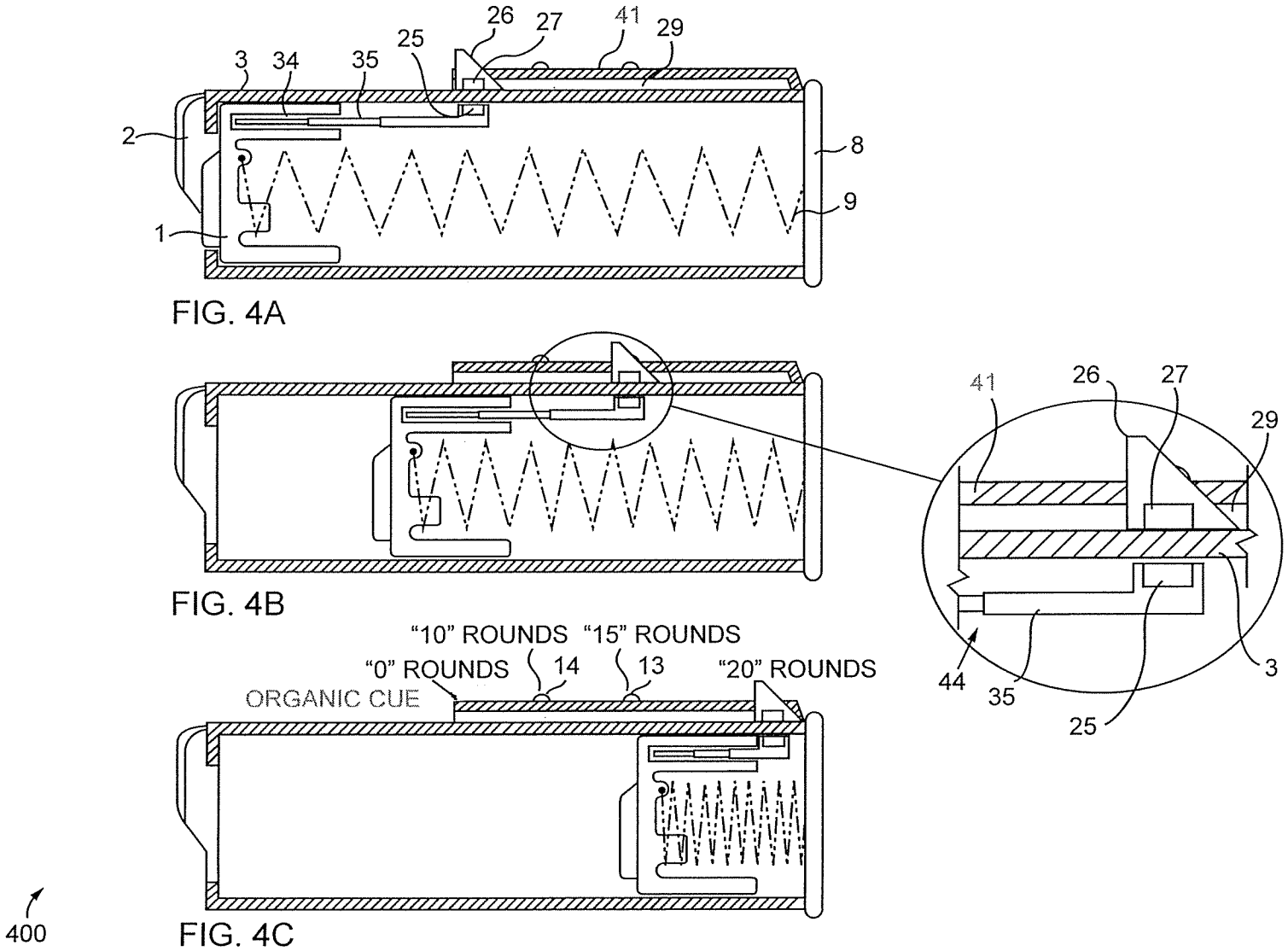
FIGS. 4A-C depict cutaway views of a box magazine according to an embodiment.

FIGS. 4A-C depict cutaway views of a box magazine according to an embodiment. The magazine 400 of FIGS. 4A-C provide tactile indication as discussed above with respect to FIGS. 2A-C; namely, via an indicator 26 having (or comprising) a magnet 27 and contained within a slotted indicator housing 41 external to the magazine body 3 and magnetically cooperating with a magnet 25 of an indicator mule assembly 44 internal to the magazine body 3. However, the mule assembly 44 depicted with respect to FIGS. 4A-C utilizes the telescoping leg 35 discussed above with respect to the magazine 300 of FIGS. 3A-C. Moreover, the slotted indicator housing 41 of FIGS. 4A-C is located toward the bottom of the magazine body 3 as depicted and described above with respect to the magazine 300 of FIGS. 3A-C.

FIG. 4A depicts the case where the magazine 400 is empty; that is, zero rounds of ammunition. In this case, the follower 1 is pushed up against the feed lips 2 by the follower spring 9, which is held in place by the floor plate 8, which is secured to the magazine body 3. The indicator 26 is protruding from a top end of the slotted indicator housing 41, thereby indicating that the number of rounds in the magazine 400 is zero. It is noted that the telescoping leg 35 is substantially fully extended.

FIG. 4B depicts the case where the magazine 400 is about half full; illustratively fifteen rounds of ammunition (not shown) in a 30 round magazine. In this case, the follower 1 is pushed toward the floor plate 8 by the number of inserted rounds of ammunition in the magazine. The tactile indicator 26 is located near the middle of the slot 29 of the slotted indicator housing 41 and adjacent to the 15 round tactile cue 13, thereby indicating that the number of rounds in the magazine 400 is approximately half of the total capacity (15 of a 30 round magazine). It is noted that the telescoping leg 35 is substantially fully extended.

FIG. 4C depicts the case where the magazine 400 is either full or at least full beyond some predetermined amount of ammunition (e.g., 15 of 15 rounds, 20 of 30 rounds and the like). In this case, the follower 1 has continued its rearward/downward movement as rounds are loaded into the magazine (past the 15 rounds indicated by the tactile indicator 26 at the base plate static cue indicating 20 or more rounds in magazine. In various embodiments, when the tactile indicator 26 is at the second end of the magazine body 3 (i.e., nearest the floor plate 8), the base plate edge acts as an organic tactile cue in relation to the position of the tactile indicator 26, it's at the base of the magazine. When a full complement of rounds are loaded into the magazine, such loading will cease movement of follower 1 at its rearward most position near the floorplate 8, at which point the follower spring 9 is fully compressed and is at maximum compressive force. As rounds are fired from the weapon or ejected from the magazine, the follower 1 will begin movement towards the feed lips 2 under compressive spring force supplied by the follower spring 9. It is noted that the telescoping leg 35 is substantially fully contracted.

Generally speaking, the static or tactile cues described herein may be provided as single cues or pairs of cues or a straight wall/line configuration of cues. Further, the cues may be of various shapes/sizes, such that individually distinctive tactile feedback to the warfighter is provided. Further, the cues may be provided on one side of the housing, multiple sides, opposite sides and so on.

Various advantages realized with the various embodiments include:

NO LOSS OF COMBAT READINESS WHEN CHECKING AMMUNITION INVENTORY: The warfighter can determine the remaining ammunition inventory of the magazine without removing their eyes from the targeting systems (iron sights, optics, scopes, etc.) and can therefore be combat ready at all times. The Shark Fin (SF) indicator can be felt by the weak or strong hand digits and also without removing the trigger finger from the trigger—thus the weapon is ready to fire on the enemy at all times.

THE WARFIGHTER CAN DETERMINE AMMUNITION INVENTORY AT ALL TIMES WITHOUT VISUAL CONFIRMATION EVEN IN TOTAL DARKNESS: The ammunition inventory can be done by tactile feel alone—therefore the inventory can be accomplished in total darkness without the need to visually see the indicators. So the shooter does not have to render the weapon inoperable while they do visual ammunition inventory and put themselves in a vulnerable situation.

THE WARFIGHTER CAN DETERMINE AMMUNITION INVENTORY AT ALL TIMES WITHOUT VISUAL CONFIRMATION EVEN IN TOTAL DARKNESS WHILE WEARING NIGHT VISION DEVICES (NVGS): The ammunition inventory may be performed by tactile feel alone—therefore the inventory can be accomplished in total darkness without the need to visually see the indicators—so wearing of NVGS does not impede the ability of the soldier to maintain fighting awareness and still inventory their ammunition.

THE INVENTION PROVIDES INDICATORS FOR ALL ROUNDS IN THE MAGAZINE EVEN ROUNDS LOCATED IN THE MAGWELL: The invention has the capability to provide indicators to the user for bullets which are located under the magwell of the weapon. This provides 100% tactile inventory of all rounds in the magazine at all times. NOTE: the last remaining rounds in the magwell are the most critical and cannot be seen but can be felt with the SF concept.

THE INVENTION IS CAPABLE OF BEING RETROFITTED TO EXISTING MAGAZINES: The tactile indicator system can be provided in a retro-fit kit form, so any operator or user of a magazine would be able to attach this invention to any existing magazine they are currently using without any modifications or with slight modifications to the magazine.

THE INVENTION HELPS AMMUNITION INVENTORY IN BULLPUP CONFIGURED WEAPONS: A Bull-Pup weapon has its magazine located between the pistol grip/trigger and the buttstock of the weapon where it (buttstock) is pressed against the shoulder of the shooter. The magazine located in this position may be more difficult to access and is unable to be easily/readily seen with the shooters eyes looking forward towards targets/threats and so to conduct ammunition inventory it takes a fair amount of weapon movement to allow the shooter to visually see the magazine by moving the weapon away from the combat load on the users chest and into the shooters field of view—this places the shooter in a very vulnerable position, the weapon is not ready for engagement. With my invention, the shooter can still maintain 100% weapon readiness and simply swipe the front strap of the magazine with the weak (support) hand to ascertain ammunition inventory without losing any weapon effectiveness.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A magazine assembly, comprising:

an elongated housing having a channel dimensioned to contain a plurality of stacked ammunition between a first and a second end of said housing, and having a slot defined along a side of said housing;

a spring-loaded follower mounted in said housing and adapted to abut against one end of the stacked ammunition adjacent said second end of said housing and configured to urge the stacked ammunition toward said first end of said housing;

a tactile indicator assembly configured to mechanically cooperate with said spring loaded follower and having a protruding portion configured to extend through said slot in said magazine housing, said protruding portion moving toward said second end of said housing as said stacked ammunition increases, and moving toward said first end of said housing as said stacked ammunition decreases;

a tensile retractor, coupled to said tactile indicator assembly and configured to urge said tactile indicator assembly toward said second end of said housing;

said tactile indicator assembly including an engagement notch configured to mechanically cooperate with an engagement notch of said spring loaded follower to urge said tactile indicator assembly toward said first end of said housing, a telescoping leg connected between said tactile indicator assembly and said spring loaded follower and configured to urge said tactile indicator assembly toward said second end of said housing.

2. The magazine assembly of claim 1, wherein:

said protruding portion of said tactile indicator assembly, when proximate a first end of said slot, indicates that said magazine stack is empty; and said protruding portion of said tactile indicator assembly, when proximate a second end of said slot, indicates that said magazine stack is at least half full.

3. The magazine assembly of claim 2, wherein said tactile indicator engagement notch and said spring loaded follower engagement notch disengage when said protruding portion of said tactile indicator is proximate the second end of said slot.

4. The magazine assembly of claim 1 wherein said slot has disposed about it said slot at least one static cue, each said static cue comprising a pair of protuberances disposed on opposing sides of said slot and configured to provide tactile indication of a respective que position along said slot.

5. The magazine assembly of claim 4, wherein said tactile indicator assembly comprises a portion of said tactile indicator assembly configured to extend through said slot in said magazine housing.

6. A magazine assembly, comprising:

an elongated housing having a channel dimensioned to contain a plurality of stacked ammunition between a first and a second end of said housing;

external indicator housing defined along a side of said elongated housing and having disposed therein a tactile indicator mule including a magnet;

a spring-loaded follower mounted in said elongated housing and adapted to abut against one end of the stacked ammunition adjacent said second end of said elongated housing and configured to urge the stacked ammunition toward said first end of said elongated housing;

a tactile indicator assembly configured to mechanically cooperate with said spring loaded follower and to magnetically cooperate with said tactile indicator mule, said tactile indicator assembly moving toward said second end of said elongated housing as said stacked ammunition increases, and moving toward said first end of said elongated housing as said stacked ammunition decreases.

7. The magazine assembly of claim 6, further comprising:

a tensile retractor, coupled to said tactile indicator assembly and configured to urge said tactile indicator assembly toward said second end of said housing;

said tactile indicator assembly including an engagement notch configured to mechanically cooperate with an engagement notch of said spring loaded follower to urge said tactile indicator assembly toward said first end of said housing.

8. The magazine assembly of claim 7, wherein:

a protruding portion of a tactile indicator, when proximate a first end of a slot, indicates that said magazine stack is empty; and said protruding portion of said tactile indicator, when proximate a second end of said slot, indicates that said magazine stack is at least half full.

9. The magazine assembly of claim 8, wherein a tactile indicator engagement notch and said spring loaded follower engagement notch disengage when a protruding portion of said tactile indicator is proximate a second end of said slot.

10. The magazine assembly of claim 6, further comprising:

a telescoping leg connected between said tactile indicator assembly and said spring loaded follower and configured to urge said tactile indicator assembly toward said second end of said housing.

11. The magazine assembly of claim 6, wherein:

said protruding portion of said tactile indicator assembly, when proximate a first end of said slot, indicates that said magazine stack is empty; and a protruding portion of a tactile indicator, when proximate a second end of a slot, indicates that a magazine stack is at least half full.

12. The magazine assembly of claim 11, wherein a tactile indicator engagement notch and a spring loaded follower engagement notch disengage when said protruding portion of said tactile indicator is proximate the second end of a slot.

13. The magazine assembly of claim 6, wherein a slot is defined along a backstrap portion of said housing.

14. The magazine assembly of claim 6, wherein said external indicator housing has disposed about the external indicator housing at least one static cue, each static cue comprising a pair of protuberances disposed on opposing sides of said external indicator housing and configured to provide tactile indication of a respective que position along said external indicator housing.

15. The magazine assembly of claim 6, wherein said external indicator housing has disposed upon the external indicator housing at least one static cue, each static cue comprising a protuberance disposed proximate said external indicator housing and configured to provide tactile indication of a respective que position along said external indicator housing.

16. The magazine assembly of claim 15, wherein a static cue indicative of a critically low amount of ammunition is configured as a different shape than other static cues.

17. The magazine assembly of claim 6, wherein said tactile indicator comprises a portion of said mule magnet configured to extend through said external indicator housing.

18. The magazine assembly of claim 6, wherein the spring-loaded follower and said tactile indicator assembly comprise a retrofit kit configured for use with an existing magazine.

* * * * *